US007596915B2

(12) United States Patent
Lee et al.

(10) Patent No.: US 7,596,915 B2
(45) Date of Patent: Oct. 6, 2009

(54) SLAB EDGE INSULATING FORM SYSTEM AND METHODS

(75) Inventors: Brain E. Lee, Corral de Tierra, CA (US); Stephan K. Barsun, Davis, CA (US); Richard C. Bourne, Davis, CA (US); Marc A. Hoeschele, Davis, CA (US); David A. Springer, Winters, CA (US)

(73) Assignee: Davis Energy Group, Inc., Davis, CA (US)

( * ) Notice: Subject to any disclaimer, the term of this patent is extended or adjusted under 35 U.S.C. 154(b) by 177 days.

(21) Appl. No.: 11/806,060

(22) Filed: May 29, 2007

(65) Prior Publication Data

US 2007/0289239 A1 Dec. 20, 2007

Related U.S. Application Data

(60) Provisional application No. 60/814,882, filed on Jun. 20, 2006.

(51) Int. Cl.

| | |
|---|---|
| ***E02D 27/32*** | (2006.01) |
| ***E04C 5/08*** | (2006.01) |
| ***E04C 3/20*** | (2006.01) |
| ***E04C 3/30*** | (2006.01) |
| ***E04G 15/00*** | (2006.01) |
| ***E04G 11/06*** | (2006.01) |
| ***B29C 39/00*** | (2006.01) |
| ***B28B 7/16*** | (2006.01) |

(52) U.S. Cl. ..... 52/223.6; 52/231; 52/294; 52/295; 52/296; 52/298; 52/576; 52/223.14; 249/35; 249/40; 249/63; 249/142; 249/217

(58) Field of Classification Search ..... 52/169.11, 52/294, 295, 296, 298, 223.6, 231, 309.12, 52/309.17, 414, 576, 223.7, 223.11, 223.14; 249/35, 40, 63, 207, 213, 217, 111, 142
See application file for complete search history.

(56) References Cited

U.S. PATENT DOCUMENTS

| | | | | | |
|---|---|---|---|---|---|
| 2,228,052 | A | * | 1/1941 | Gardner | 52/396.03 |
| 3,137,971 | A | * | 6/1964 | Rhodes | 52/223.13 |
| 3,605,361 | A | * | 9/1971 | Howlett et al. | 52/223.13 |
| 3,614,052 | A | * | 10/1971 | Babbage | 249/23 |
| 3,676,968 | A | * | 7/1972 | Campbell | 52/223.6 |

(Continued)

*Primary Examiner*—Richard E Chilcot, Jr.
*Assistant Examiner*—Andrew J Triggs
(74) *Attorney, Agent, or Firm*—Oliff & Berridge, PLC

(57) ABSTRACT

A method of forming an insulated concrete foundation is provided comprising constructing a foundation frame, the frame comprising an insulating form having an opening, inserting a pocket former into the opening; placing concrete inside the foundation frame; and removing the pocket former after the placed concrete has set, wherein the concrete forms a pocket in the placed concrete that is accessible through the opening. The method may further comprise sealing the opening by placing a sealing plug or sealing material in the opening. A system for forming an insulated concrete foundation is provided comprising a plurality of interconnected insulating forms, the insulating forms having a rigid outer member protecting and encasing an insulating material, and at least one gripping lip extending outwardly from the outer member to provide a pest barrier. At least one insulating form has an opening into which a removable pocket former is inserted. The system may also provide a tension anchor positioned in the pocket former and a tendon connected to the tension anchor.

22 Claims, 9 Drawing Sheets

U.S. PATENT DOCUMENTS 3,685,934 A * 8/1972 Huber et al. ..... 425/111
3,766,609 A * 10/1973 Brandestini et al. ..... 24/115 R
3,833,706 A * 9/1974 Edwards ..... 264/228
3,844,697 A * 10/1974 Edwards ..... 425/111
3,936,256 A * 2/1976 Howlett et al. ..... 425/111
3,956,797 A * 5/1976 Brandestini et al. ..... 52/223.13
4,054,258 A * 10/1977 Holmboe ..... 249/214
4,170,853 A * 10/1979 Kohaut ..... 52/99
4,334,394 A * 6/1982 Mader ..... 52/309.12
4,335,548 A 6/1982 Rehbein
4,363,462 A * 12/1982 Wlodkowski et al. ..... 249/190
4,409,766 A * 10/1983 Blackmore ..... 52/169.11
4,524,553 A * 6/1985 Hacker ..... 52/169.11
4,674,255 A * 6/1987 Derome ..... 52/750
4,711,058 A * 12/1987 Patton ..... 52/101
4,719,658 A * 1/1988 Kriofske ..... 52/223.13
4,773,198 A * 9/1988 Reinhardt ..... 52/223.13
4,821,474 A * 4/1989 Rodriguez ..... 52/223.13
4,848,052 A * 7/1989 Nutzel ..... 52/223.13
4,862,660 A * 9/1989 Raymond ..... 52/220.2
4,896,470 A * 1/1990 Sorkin ..... 52/223.13
5,024,032 A * 6/1991 Rodriguez ..... 52/223.13
5,072,558 A * 12/1991 Sorkin et al. ..... 52/223.13
5,174,083 A 12/1992 Mussell
5,347,777 A * 9/1994 Sudduth ..... 52/223.13
5,351,454 A * 10/1994 Hahne et al. ..... 52/309.17
5,423,362 A * 6/1995 Knight ..... 249/91
5,436,425 A * 7/1995 Sorkin ..... 219/121.44
5,488,806 A * 2/1996 Melnick et al. ..... 52/425
5,664,382 A * 9/1997 Melnick et al. ..... 52/425
5,817,247 A * 10/1998 Colatruglio ..... 249/4
5,894,704 A * 4/1999 Watkins ..... 52/745.09
5,897,102 A * 4/1999 Sorkin ..... 254/29 A
6,023,894 A * 2/2000 Sorkin ..... 52/223.8
6,185,884 B1 * 2/2001 Myers et al. ..... 52/215
6,381,912 B1 * 5/2002 Sorkin ..... 52/223.13
6,393,781 B1 * 5/2002 Sorkin ..... 52/223.13
6,401,417 B1 * 6/2002 Leblang ..... 52/481.1
6,546,679 B1 * 4/2003 Bushberger ..... 52/169.14
6,629,394 B1 * 10/2003 Trevino ..... 52/677
6,631,596 B1 * 10/2003 Sorkin ..... 52/223.13
6,651,949 B1 * 11/2003 Westhoff et al. ..... 249/63
6,679,021 B2 * 1/2004 Maimon et al. ..... 52/592.1
6,684,585 B2 * 2/2004 Campbell ..... 52/223.13
6,761,002 B1 * 7/2004 Sorkin ..... 52/223.13
7,000,359 B2 * 2/2006 Meyer ..... 52/309.9
7,174,685 B2 * 2/2007 Hayes ..... 52/223.6
7,188,455 B2 * 3/2007 Brugeaud et al. ..... 52/576
7,216,842 B2 * 5/2007 Watson ..... 249/177
7,275,347 B2 * 10/2007 Hayes ..... 52/223.13
7,424,792 B1 * 9/2008 Sorkin ..... 52/223.13
2001/0027630 A1 * 10/2001 Moore et al. ..... 52/741.13
2002/0007604 A1 * 1/2002 Wallstein ..... 52/223.13
2002/0116888 A1 * 8/2002 Jorn et al. ..... 52/426
2003/0019175 A1 * 1/2003 Kremers ..... 52/294
2003/0056462 A1 * 3/2003 Roy, Sr. ..... 52/741.13
2003/0233798 A1 * 12/2003 Berkey et al. ..... 52/223.7
2004/0118063 A1 * 6/2004 Shidler ..... 52/309.11
2004/0148880 A1 * 8/2004 Hayes ..... 52/223.1
2004/0148881 A1 * 8/2004 Hayes ..... 52/223.13
2004/0148882 A1 * 8/2004 Hayes ..... 52/223.14
2004/0163341 A1 * 8/2004 Gregory et al. ..... 52/294
2006/0000168 A1 1/2006 Compton
2006/0033003 A1 * 2/2006 Watson ..... 249/177
2007/0289239 A1 * 12/2007 Lee et al. ..... 52/426
2008/0178545 A1 * 7/2008 Finkelshteyn ..... 52/294

* cited by examiner

SLAB EDGE INSULATING FORM SYSTEM AND METHODS

This nonprovisional application claims the benefit of U.S. Provisional Application No. 60/814,882, filed Jun. 20, 2006.

This invention was made with Government support under Cooperative Agreement No. DE-FC26-05NT42320 awarded by the Department of Energy. The Government has certain rights in this invention.

BACKGROUND OF INVENTION

1. Field of Invention

This invention relates to concrete slab-on-grade fabrication, and more particularly, to systems and methods for forming insulated concrete foundations.

2. Description of Relevant Art

Combining formwork with insulation improves building thermal performance by providing a concrete foundation with insulation, and speeds installation by eliminating the need to strip concrete forms after slab pour. Among the benefits of utilizing "leave-in-place" insulation forms are reduced heating season energy consumption (and associated emissions reductions) and reduced jobsite waste because disposable wood form boards are not being used.

A conventional method uses a "leave-in-place" insulation form that comprises a rigid plastic outer piece filled with foam insulation. This system requires a separate footing pour to provide a rigid anchor for the outer forms, which increases both material and labor costs. This system does not provide a continuous termite barrier to protect the building framing from termite infestation.

Integrated concrete forms, or ICFs, have recently gained widespread use. Integrated concrete forms usually consist of hollow blocks made of expanded polystyrene reinforced with metal or plastic straps. They are used to build foundation walls and even above-grade structure walls. However, the use of ICFs on standard slab-on-grade foundations common to many tract homes is limited, because ICFs require level footings and also that the two sides of the ICFs be tied together.

Conventional slab-edge insulation practice is to frame a slab foundation using wood form boards (or other materials), pour the foundation, and then remove and dispose of the forms. The slab-edge insulation for the foundation is then secured to the slab in an entirely subsequent operation. Thus, conventional slab-edge insulation practice requires three distinct processes and often three different visits to the home site to perform each of the three processes, respectively.

What is needed are systems and methods for forming insulated concrete foundations that eliminate two of those processes. What is needed is a cost effective system to integrally form and insulate concrete slab foundations while providing pest resistance and the ability to work with post tension slab techniques that have become commonplace in many areas of the country. What is needed are leave-in-place slab-edge insulated forms that are robust, simple to install, and utilize corner and linear joining pieces that facilitate installation.

The above factors suggest a need and opportunity for improved systems and methods for forming insulated concrete foundations that reduce costs and enhance installation reliability.

SUMMARY OF INVENTION

The present invention is directed to improved systems and methods of forming insulated concrete slab foundations. In accordance with one embodiment of the invention, the form system comprises 12 foot lengths of foam panels, such as in 12-foot lengths, that enclose insulation material in a rigid covering for stiffness, protection, and UV durability. The system provides for joining adjacent forms using connectors to form a perimeter of a foundation. Methods are also provided for integrating post tension hardware.

In embodiments, a system for forming an insulated concrete foundation is provided, the system comprising a plurality of interconnected insulating forms. The insulating forms having a rigid outer surface encasing an insulating material, and an inner side surface with an upper gripping lip and a lower gripping lip extending therefrom. The upper lip is positioned on the inner side surface to provide a pest barrier.

A system for forming an insulated concrete foundation as described in claim 1, wherein at least one insulating form has an opening, the system further comprising a removable pocket former inserted into the opening. Positioned in the pocket former is a tension anchor and a tendon connected to the tension anchor. The tension anchor is secured to the inner side surface of the insulating forms by one or more tension anchor braces by the upper gripping lip and lower gripping lip.

In embodiments, the system for forming an insulated concrete foundation further comprises connectors for connecting adjacent pairs of insulating forms. These connectors include connecting strips and vertical couplers. The vertical couplers have a tube for receiving insulating material, and pairs of vertical fins extending from the tube to provide guides for slidingly receiving ends of adjacent insulating forms.

In embodiments, an improved method is provided for forming an insulated concrete foundation, comprising the steps of constructing a foundation frame, the frame comprising an insulating form having an opening inserting a pocket former into the opening; placing concrete inside the foundation frame; and removing the pocket former after the placed concrete has set, wherein the concrete forms a pocket in the placed concrete that is accessible through the opening. The method also comprises positioning a tension anchor inside the pocket former, and sealing the opening by placing a sealing plug in the opening or sealing material in the opening. The method may also provide creating an opening in the insulating form.

A pocket former is provided that forms a pocket in an outer surface of a concrete foundation, the pocket former being removable through an opening in an insulating form so that pocket is accessible through the opening. The pocket former has a conical portion, a cylindrical portion, and an outer surface that is threaded.

These and other objects and advantages will be apparent to those skilled in the art in light of the following disclosure, claims and accompanying drawings.

BRIEF DESCRIPTION OF THE DRAWINGS

Various exemplary embodiments of the systems and methods of this invention will be described in detail, with reference to the following figures, wherein.

DETAILED DESCRIPTION OF EMBODIMENTS

Embodiments of the present invention provide systems and methods for forming insulated concrete foundations. A description of these embodiments is provided with reference to drawing FIGS. 1-12.

Figure 1:
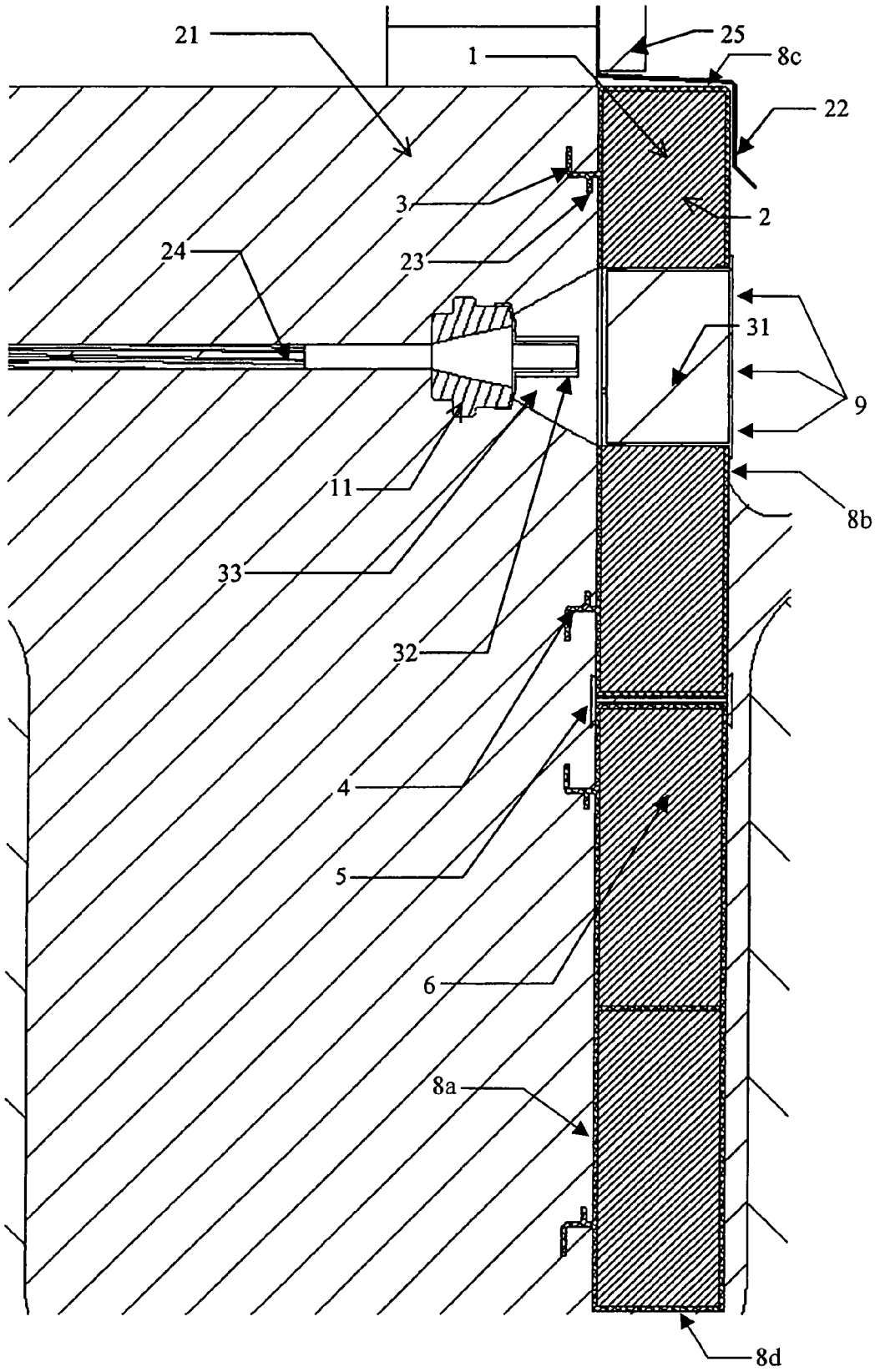
FIG. 1 is a side sectional view of an exemplary embodiment of a slab edge insulating form system.

FIG. 1 illustrates a forming insulation system and associated foundation and framing components. It provides a side sectional view through the principal plane of the form and post tension anchor to show the system in place after the foundation has been poured and a wall constructed. With reference to FIG. 1, the following features of the embodiment of the system for forming insulated concrete foundations are described.

An insulating form 1 comprises a rigid outer member 8 with an inner side surface 8*a*, an outer side surface 8*b*, a top surface *c*, a bottom surface 8*d*, and opposing ends 8e. The rigid outer member 8 of the form 1 encloses insulating material 2 such as but not limited to insulating foam, protecting the insulating foam from weather, ultraviolet light, and physical damage. At least one gripping lip extends outwardly from an inner side surface 8*a* of the outer member 8, such as an upper gripping lip 3. In the preferred embodiment, the upper gripping lip 3 is positioned offset from the top and bottom of the form 1 to provide a pest barrier that prevents pests from reaching the structure without being detected. An additional lower gripping lip 4 may be provided closer to the bottom of the form 1. The gripping lips 3 and 4 assist in mechanically locking the form 1 to the poured foundation 21. The upper gripping lip 3 may alternatively be referred to herein as a termite strip. In the preferred embodiment, the upper 3 and lower 4 gripping lips are symmetrical in shape so that the form 1 is vertically symmetrical about its generally vertical midpoint.

A snap-in-place connecting strip 5 may be utilized to allow a second form 6 adjacent to the first form 1 to be attached to the bottom of the first form 1 to accommodate insulation to the bottom of the foundation footing using a similar enclosed insulation section. Alternatively, the connecting strip 5 can be used to attach a below grade foam without a rigid covering (not shown) as a more economical full depth solution.

In one embodiment, a sealing plug 31 is used to seal the opening 9 cut in the form to access a post tension anchor 11 and tendon 24. In the preferred embodiment, the opening 9 is cylindrical to slidingly receive the pocket formers 33 having the configurations such as shown, for example, in FIGS. 7 and 8.; however, other opening configurations may be utilized. A sealing cap 32 and grout or other sealing material 33 may also be used to seal the end of the post tension system to protect it from moisture intrusion and corrosion.

At the top of form 1 is a flashing 22 that directs water away from the form and foundation and is placed under the framing siding or stucco 25.

Figure 2:
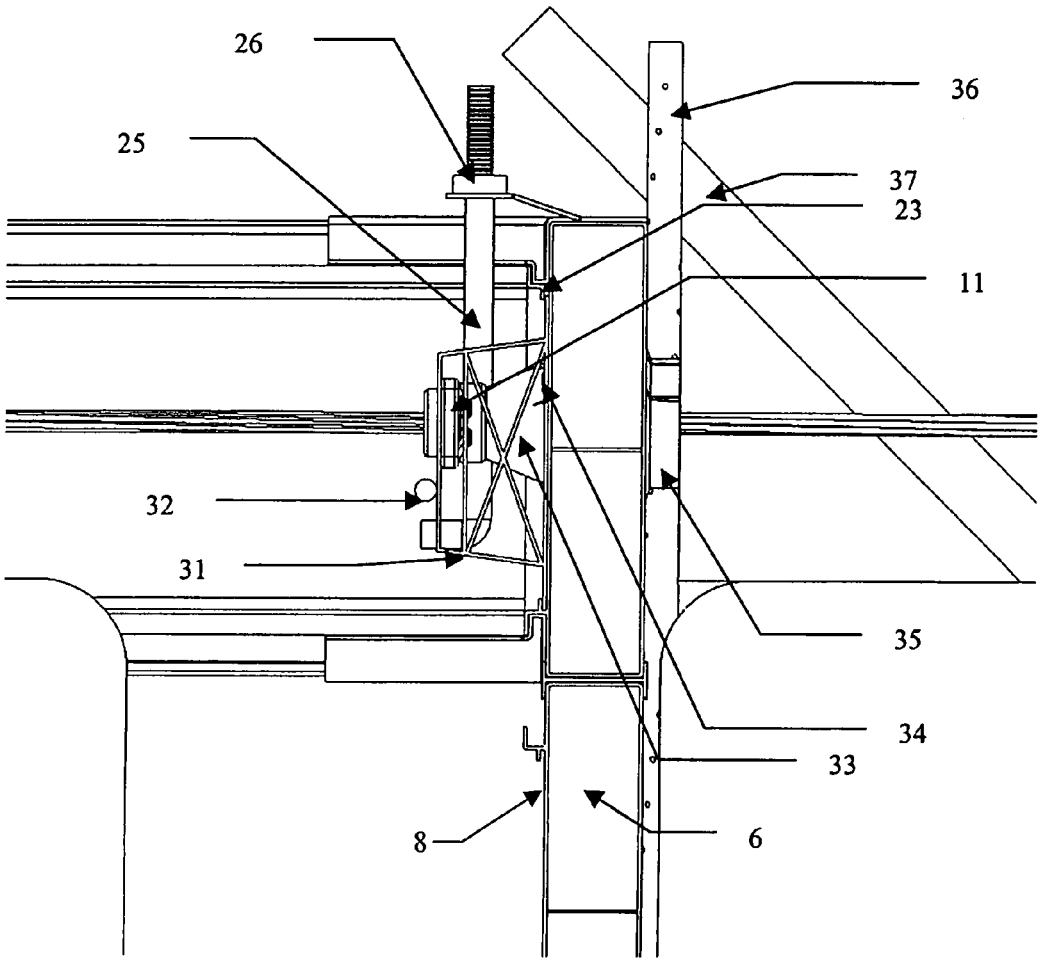
FIG. 2 is a side view of another embodiment of a slab edge insulating form system.
Figure 7:
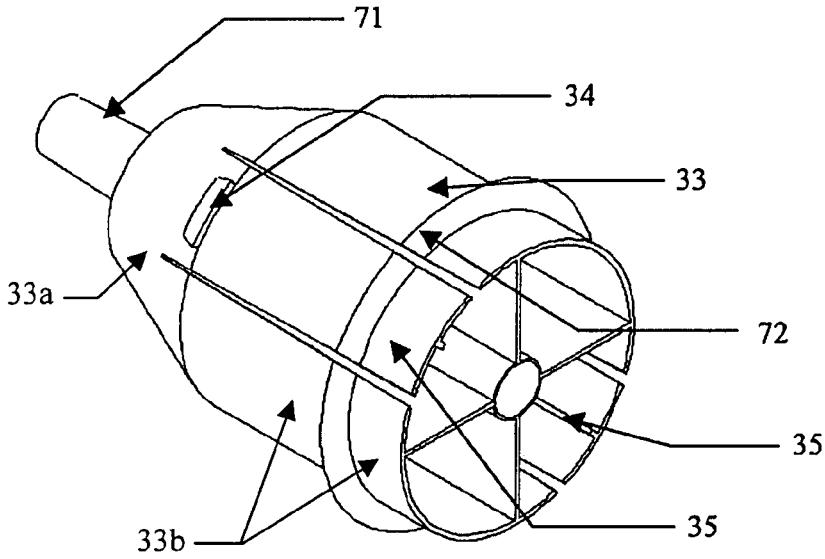
FIG. 7 is a perspective view of an embodiment of a snap-in type removable pocket former.
Figure 8:
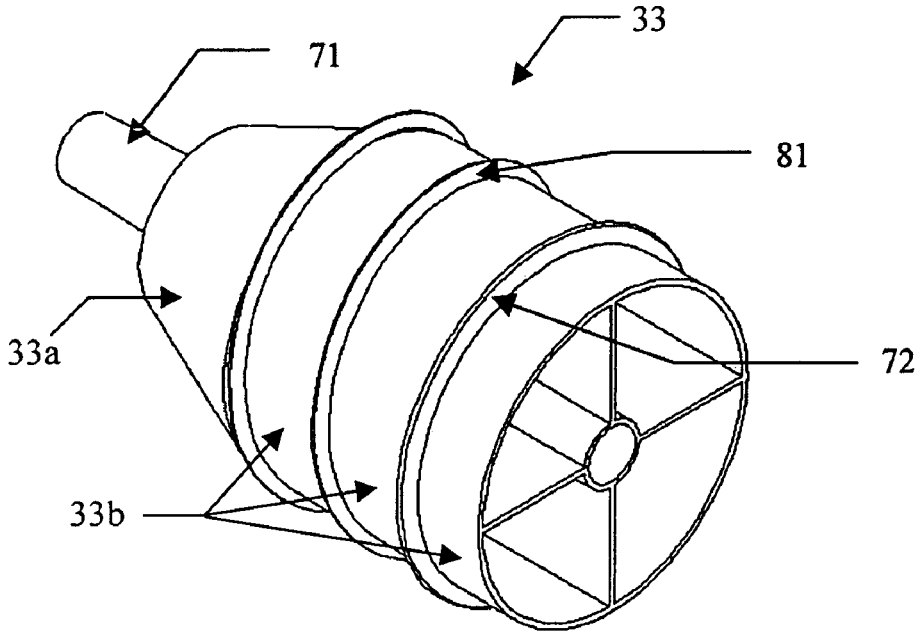
FIG. 8 is a perspective view of an embodiment of a screw-in type removable pocket former.

FIG. 2 illustrates a system in place before the foundation 21 is poured and exhibits further details of the system. One or more tension braces 31 provide a mounting point for post tension anchors 11 and rebar reinforcing rods 32. The rebar rods 32 that typically run perpendicular to the tendon, are shown inside of the brace but could be positioned inside to eliminate the need for ties, etc. to hold them in place. Strips 23 projecting from the upper and lower gripping lips 3 and 4 allow for securement of post tension anchor braces 31. A removable pocket former 33 protrudes through the form 1 and extends beyond both sides thereof to provide for the creation of a pocket in the concrete to access the anchor through the opening 9 in the insulating form 1. In the preferred embodiment, the pocket former 33 is held in place via snaps 34 that are activated by levers 35. The pocket former 33 is illustrated in FIGS. 7 and 8.

The insulating form 1 is held in place by one or more vertical foundation stakes 36 attached to both the adjacent insulating forms 1 and 6; and a diagonal brace stake 37. These stakes 36 and 37 rigidly hold the forms 1 and optional adjacent form 6 in place before and during foundation pouring. This attachment will preferably be made with screws. Alternate embodiments may use other fasteners such as nails or clips to perform this attachment. For example, as shown in FIG. 2, a tie down anchor 26 such as the Simpson Strong Tie series may be attached to the forms 1 and 6 to hold a j bolt 25 to anchor walls to the foundation 21.

An exemplary embodiment of a system for forming an insulated concrete foundation 21 is provided, the system comprising a plurality of interconnected insulating forms such as, for example, forms 1 and 6. The insulating forms 1 and 6 have a rigid outer surface encasing an insulating material 2 such as insulating foam. The systems have an inner side surface with an upper gripping lip 3 and a lower gripping lip 4 extending therefrom. The upper gripping lip 3 is positioned on the inner side surface to provide a pest barrier, a "termite stop" strip, that prevents termites from creating hidden tunnels through the foam to the wall framing 25 positioned above the foundation.

Figure 3:
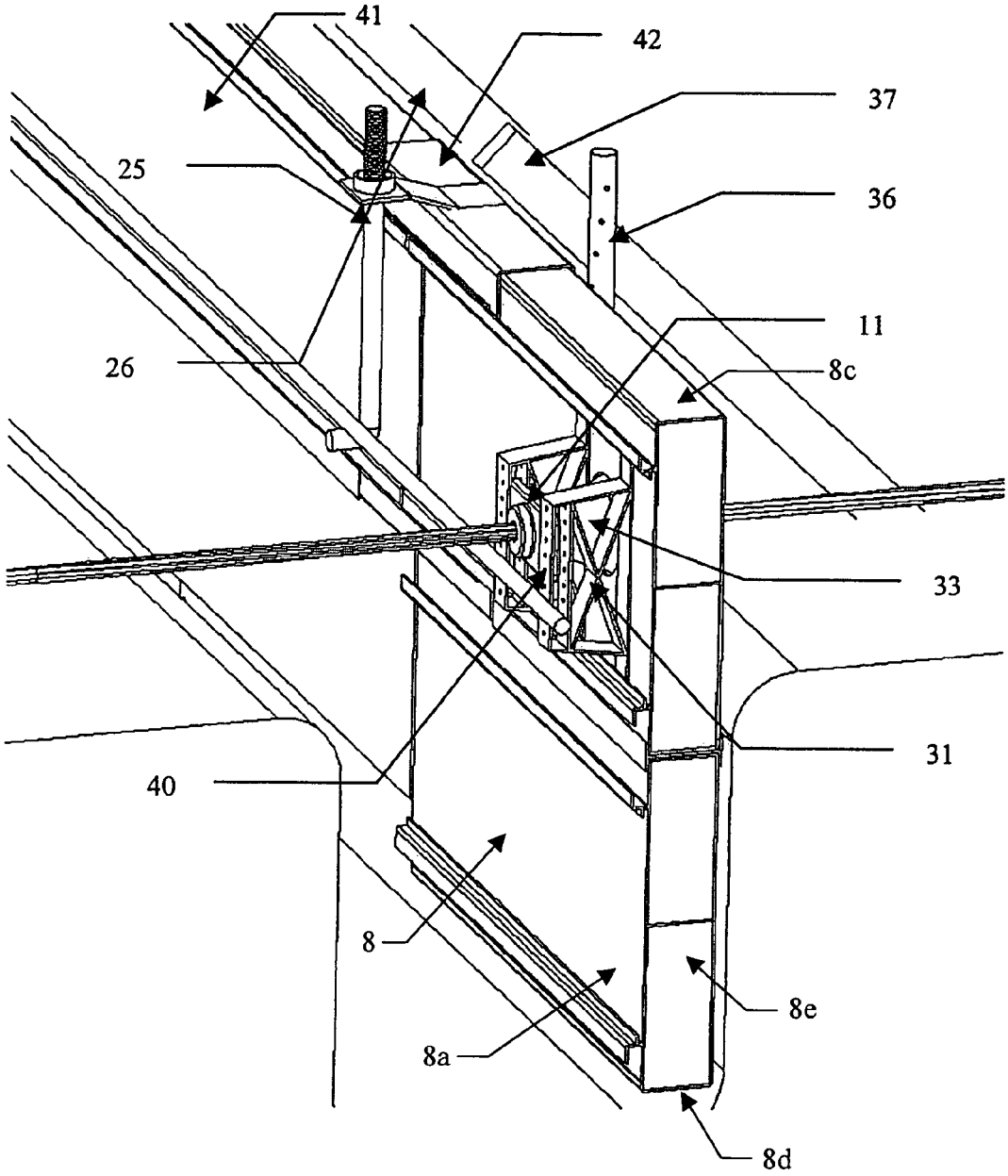
FIG. 3 is a perspective view of the embodiment of a slab edge insulating form system shown in FIG. 2.

An exemplary embodiment provides at least one insulating form with an opening 9 into which a removable pocket former 33 is inserted. The pocket former can be a snap-in type as shown in FIG. 7 or a threaded type as shown in FIG. 8. For the threaded type, an outer surface of the pocket former is threaded. The system, in embodiments, further provides a tension anchor 11 positioned in the pocket former 33 and a tendon 24 connected to the tension anchor 11. One or more tension anchor braces 31 are secured to the inner side surface of the insulating forms by the upper gripping lip 3 and lower gripping lip 4 utilizing the strips 23 as shown in FIGS. 2 and 3.

Figure 10:
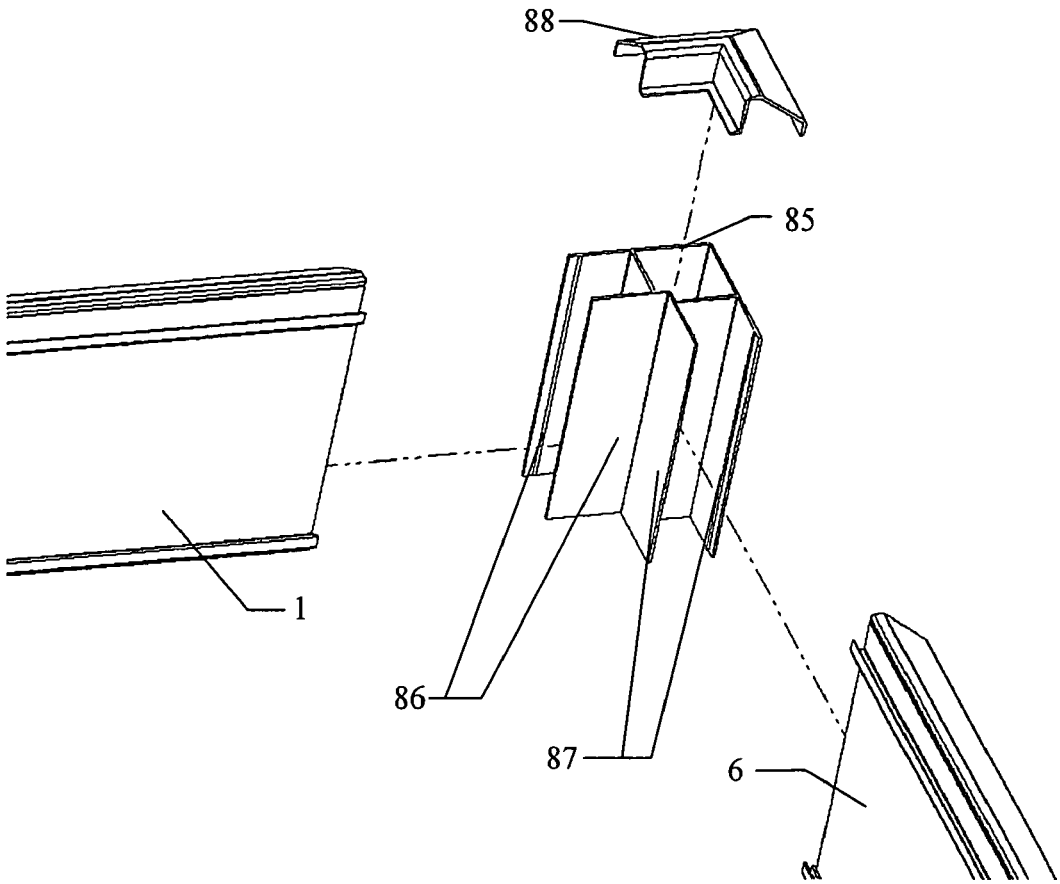
FIG. 10 is an exploded view of an adjacent pair of insulating forms connected by an exemplary embodiment of a vertical coupler.

The system also provides means for connecting adjacent insulating forms such as a connecting strip 5 shown in FIG. 1. In another embodiment, a vertical coupler 84 as shown in FIG. 10 is used to connect an adjacent pair of insulating forms 1 and 6. The vertical coupler 84 has a tube portion 85 for receiving insulating material, a first pair of vertical fins 86 extending from the tube 85 to provide a first guide for slidingly receiving an end of a first insulating form 1 therebetween, and a second pair of vertical fins 87 extending from the tube 85 to provide a second guide for slidingly receiving an end of a second insulating form 6 therebetween. A cap 88 is also provided for placement on the top of the vertical coupler 84. A conventional sealant (not shown) may applied to form a contiguous seal between the cap 88 and the first and second insulating forms 1 and 6, respectively.

The vertical coupler 84 is an extruded shape with a hollow center 85 to allow a piece of insulation to be installed. This eliminates the need for expensive and complicated injection molds for the corners. Additionally, the vertical coupler 84 allows multiple form heights to be accommodated using the same tooling by simply cutting the extrusion to the proper length. For external corners, the hollow center 85 allows the two extruded pieces to be cut to the length on the plans for the exterior of the foundation without the need to overlap forms, simplifying form cutting and setup. The end fins 86 and 87 slide into the same tabs used by the anchor and rebar braces to hold the forms level and assist in holding the corner to the forms.

Figure 11:
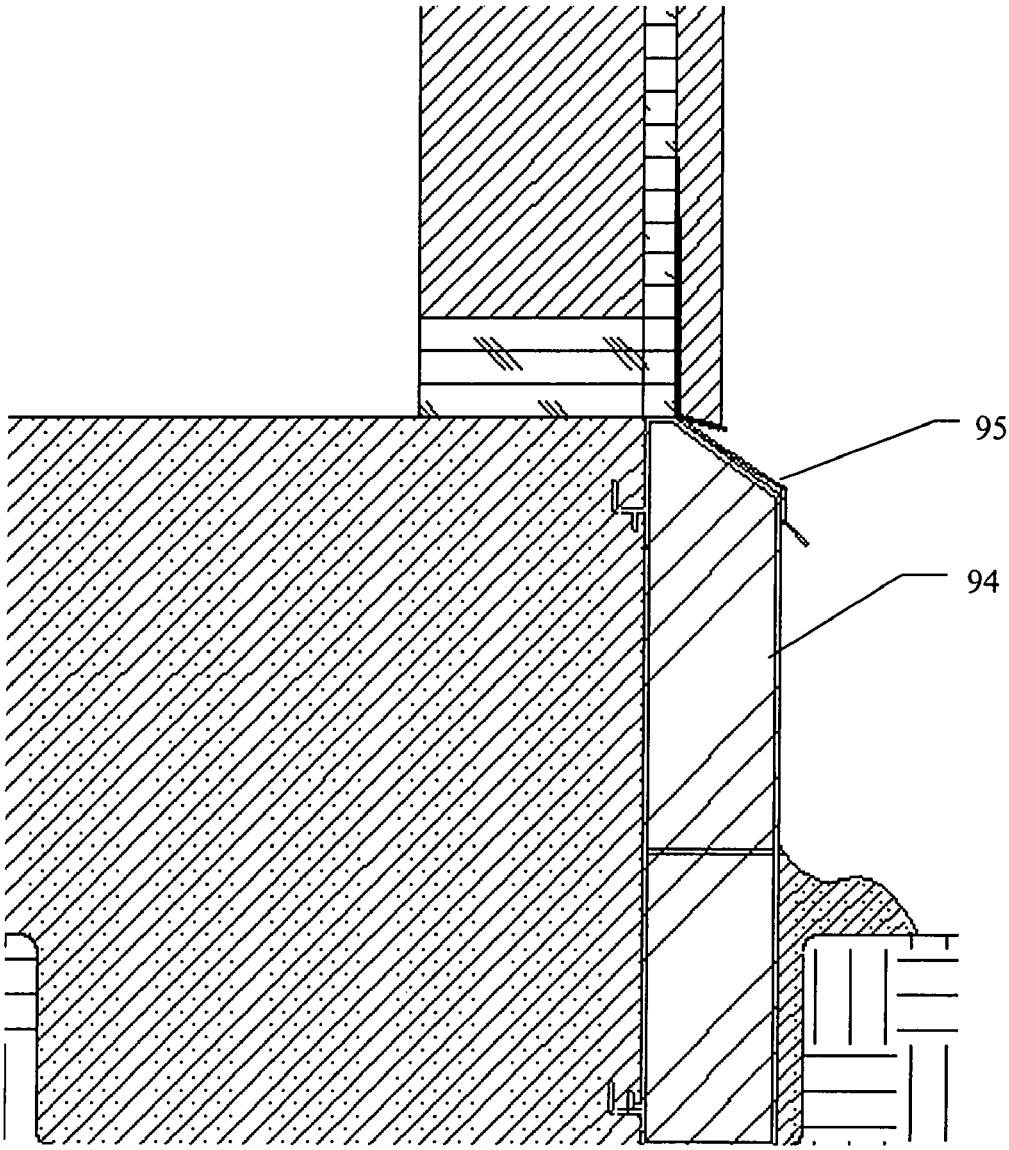
FIG. 11 is a side sectional view of another embodiment of a slab edge insulating form system having insulating forms having a top that is partially sloped.

An embodiment of the system provides flashing (22 in FIGS. 1 and 95 in FIG. 11) positioned above a top surface of the insulating forms. An embodiment of the system shown in FIG. 11 provides an insulating form 94 having a top that is partially sloped. The embodiment shown in FIG. 11 incorporates a top edge that has a small flat surface (~0.5") that sits under the sheeting on the outside of the house. A sloped surface beyond this flat section slopes away from the house to facilitate drainage to meet requirements for weep screeds for stucco houses. All stucco homes must have a weep screed to facilitate drainage that begins at or below the foundation sill plate and terminates at least 1 inch below the sill plate. The custom flashing takes the place of the traditional weep screed and allows the form to sit outside the sill plate.

FIG. 3 shows the system of FIG. 2 in an isometric view. The braces 31 are shown to include holes 40 that allow rebar 32 and the tension anchor 11 to be attached using ties, zip ties, screws, or snap features. The insulation form 1 is connected to identical form 41 by coupler 42.

Figure 4:
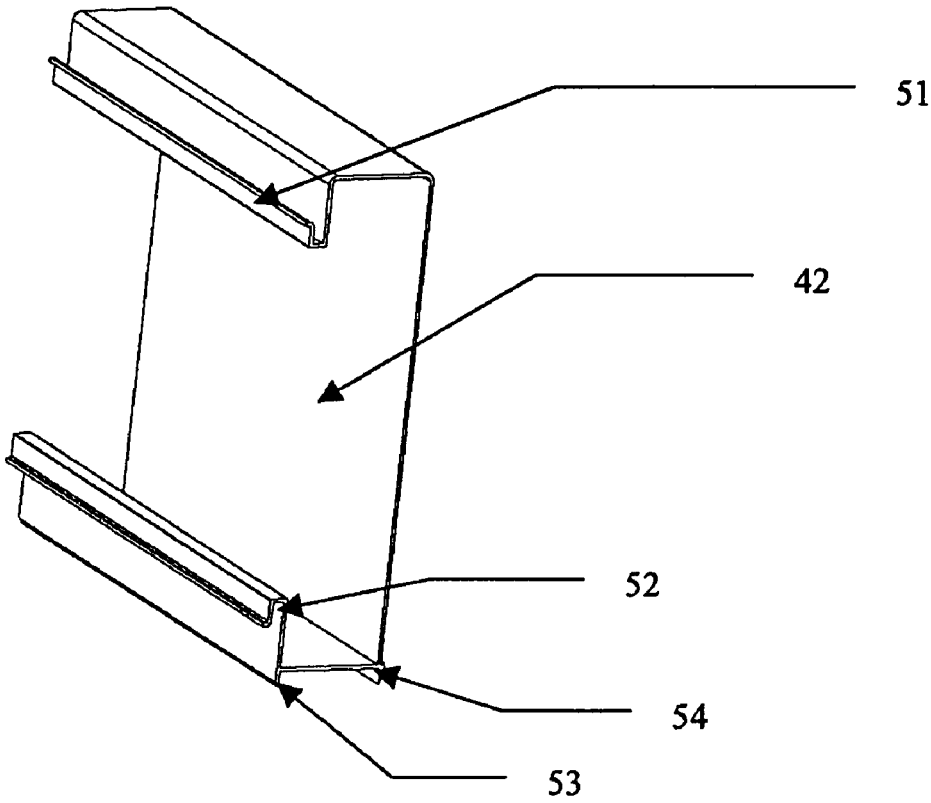
FIG. 4 is a perspective view of an embodiment of a linear connector.

FIG. 4 shows in more detail a coupler 42 that is formed of an open extrusion of rigid material. The coupler includes a top groove 51 and a bottom groove 52 to continue the termite strip protection of the insulating form shown in other Figures. Optional tabs 53 and 54 at the bottom of the coupler allow it to grip an optional second extrusion or foam beneath the top form.

Figure 5:
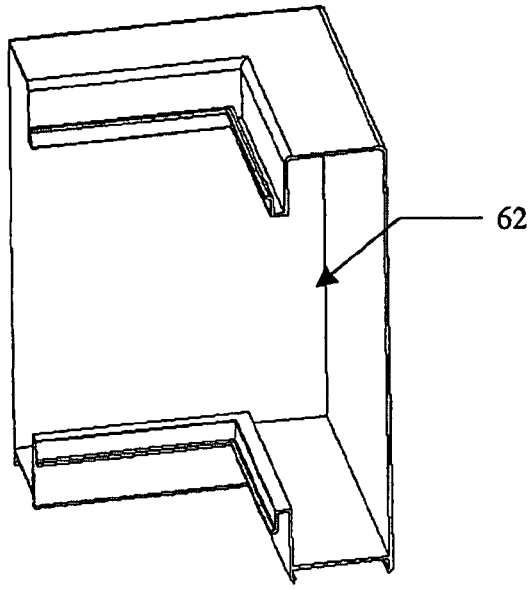
FIG. 5 is a perspective view of an embodiment of a corner connector.
Figure 6:
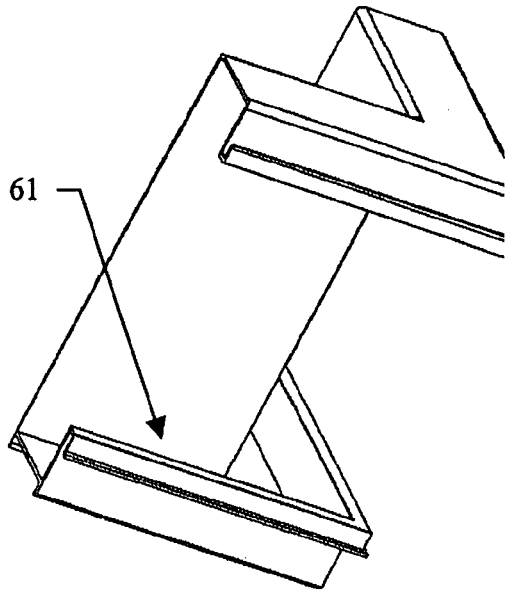
FIG. 6 is a perspective view of another embodiment of a corner connector; a slab edge insulating form system shown in FIG. 2.

FIG. 5 illustrates an outer 90-degree corner 62. FIG. 6 illustrates an inner 90 degree corner 61. These corners mimic the contour of the linear coupler 42 but provide for a corner to be formed. They may be constructed through a molding, extrude miter and cut, or metal bending process.

FIG. 7 illustrates the preferred embodiment of a pocket former 33. The tip 71 is formed to interface with pocket coupler 11 shown, for example, in FIG. 1. The annular flange 72 provides a positive stop on the outside of the form. FIG. 8 shows an alternative embodiment of the pocket former 33. In this embodiment, a coarse threading 81 is used to removably secure the pocket 33 to the form. The tip 71 and ring 72 of the preferred embodiment are used. The exemplary embodiments of a pocket former 33 have a conical portion 33*a* that engages the concrete foundation to form a conical pocket, and a cylindrical portion 33*b* that slidingly engages the opening 9 in the insulating form 1.

Figure 9:
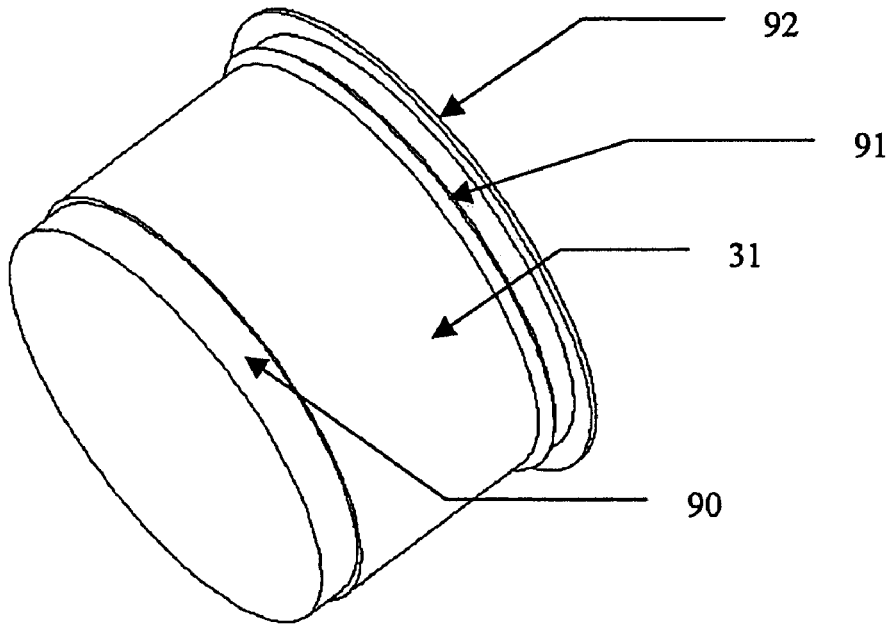
FIG. 9 is a perspective view of an embodiment of a sealing plug.

FIG. 9 shows an embodiment of a sealing plug 31 (filled with insulation 90) to seal the opening 9 in the form. This protects the post tension system, and maintains the insulative properties of the form at opening portions. A snap ring 91 and stop 92 provide means to hold the cap to the form in addition to potential use of adhesives. The snap ring is shown to be continuous through the revolution of the plug but an alternate embodiment could break the continuous ring into discrete sections. These snap sections could be lined up with corresponding gaps in the ring 91 to facilitate injection molding.

Figure 12:
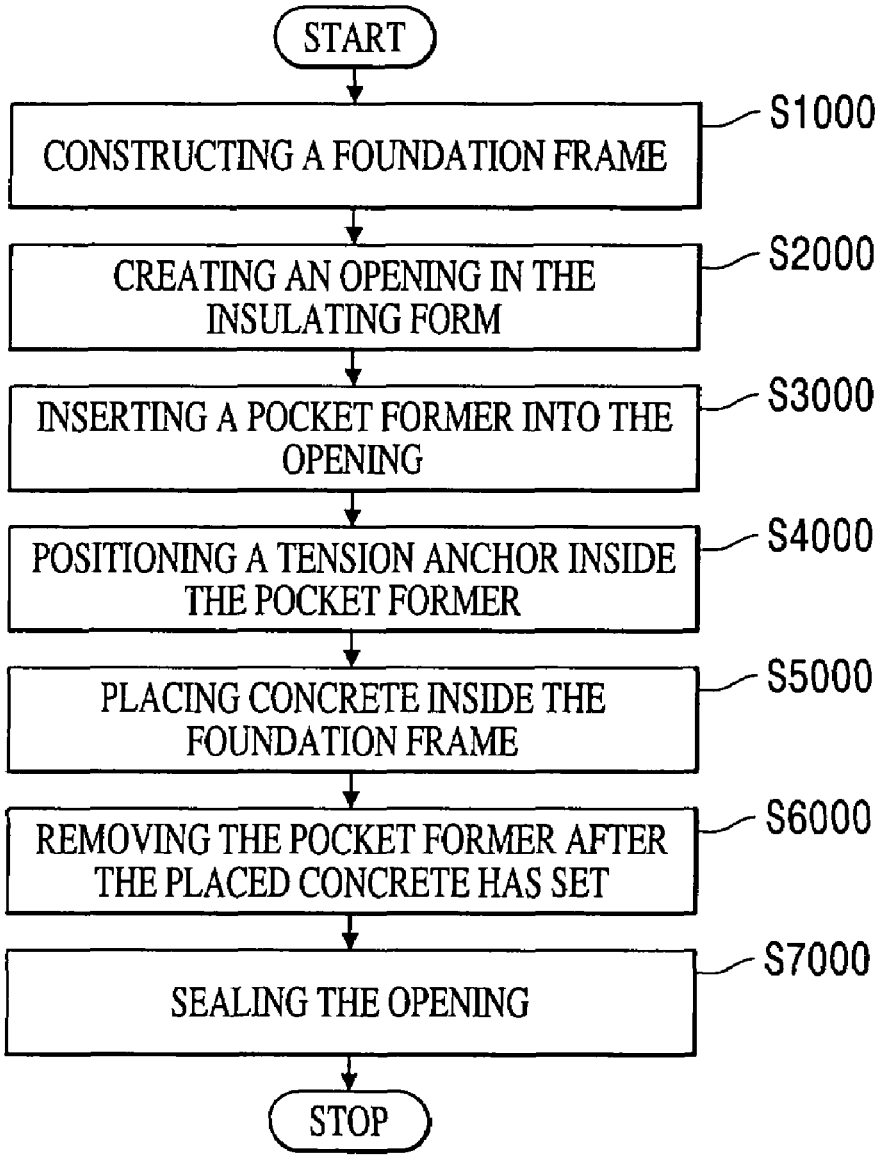
FIG. 12 is a flowchart illustrating an exemplary method of forming an insulated concrete foundation.

An exemplary method of forming an insulated concrete foundation is provided, which as shown in FIG. 12, comprises the steps of constructing a foundation frame S1000, the frame comprising an insulating form having an opening; inserting a pocket former into the opening S3000; placing concrete inside the foundation frame S5000; and removing the pocket former after the placed concrete has set S6000 so that that the concrete forms a pocket in the placed concrete that is accessible through the opening. The method also comprises positioning a tension anchor inside the pocket former S4000; and sealing the opening S7000 by placing a sealing plug in the opening or placing a sealing material in the opening. The method may also provide creating an opening in the insulating form S2000.

Although the subject matter of this application has been described with reference to various exemplary embodiments, it is to be understood that the subject matter is not limited to the exemplary embodiments or constructions. To the contrary, the subject matter of this application is intended to cover various modifications and equivalent arrangements. In addition, while the various elements of the exemplary embodiments are shown in various combinations and configurations, others combinations and configurations, including more, less, or only a single element, are also within the spirit and scope of the invention.

What is claimed is:

1. A system for forming an insulated concrete foundation, the system comprising:

a plurality of interconnected insulating forms, the insulating forms having:

an insulating material;

a rigid outer member, having an inner side surface, encasing the insulating material on at least four surfaces; and at least one gripping lip extending outwardly from the inner side surface of the outer member; and a pocket former that forms a conical pocket in an outer surface of a concrete foundation, the pocket former further comprising:

a cylindrical portion; and a conical portion, and wherein the pocket former is removable from the concrete foundation through an opening in one of the insulating forms such that the conical pocket is accessible through the opening.

2. A system for forming an insulated concrete foundation as described in claim 1, wherein one of the at least one gripping lip is positioned to provide a pest barrier.

3. A system for forming an insulated concrete foundation as described in claim 1, wherein at least one of the plurality of insulating forms has an opening, the system further comprising a removable pocket former inserted into the opening.

4. A system for forming an insulated concrete foundation as described in claim 3, wherein an outer surface of the pocket former is threaded.

5. A system for forming an insulated concrete foundation as described in claim 3, further comprising a tension anchor positioned in the pocket former and a tendon connected to the tension anchor.

6. A system for forming an insulated concrete foundation as described in claim 5, further comprising at least one tension anchor brace secured to the inner side surface of the outer member by an upper gripping lip and a lower gripping lip.

7. A system for forming an insulated concrete foundation as described in claim 1, further comprising a connecting strip that connects an adjacent pair of insulating forms.

8. A system for forming an insulated concrete foundation as described in claim 1, further comprising a connecting strip that connects at least one of the insulating forms to a below grade foam without a rigid covering.

9. A system for forming an insulated concrete foundation as described in claim 1, further comprising a vertical coupler that connects an adjacent pair of insulating forms, the vertical coupler having a tube for receiving the insulating material, a first pair of vertical fins extending from the tube to provide a first guide for slidingly receiving an end of a first insulating form therebetween, and a second pair of vertical fins extending from the tube to provide a second guide for slidingly receiving an end of a second insulating form therebetween.

10. A system for forming an insulated concrete foundation as described in claim 9, further comprising a cap placed on the top of the vertical coupler, and a sealant applied to form a contiguous seal between the cap and the first and second insulating forms.

11. A system for forming an insulated concrete foundation as described in claim 1, wherein the insulating forms have a top that is partially sloped.

12. A system for forming an insulated concrete foundation as described in claim 1, further comprising a flashing positioned above a top surface of the insulating forms.

13. A system for forming an insulated concrete foundation as described claim 1, wherein the pocket former has an outer surface that includes at least one snap to removably hold the pocket former in place.

14. A method of forming an insulated concrete foundation, comprising:

constructing a foundation frame, the frame including an insulating form having an opening, the insulating form having an insulating material and a rigid outer member, the rigid outer member having an inner side surface encasing the insulating material on at least four surfaces:

inserting a pocket former into the opening, the pocket former forming a conical pocket in an outer surface of a concrete foundation, and further comprising:

a cylindrical portion; and a conical portion, pouring concrete inside the foundation frame; and removing the pocket former after the concrete has set after being placed, wherein the concrete forms a pocket in the placed concrete that is accessible through the opening and the pocket former is removable from the concrete foundation through the opening in the insulating form.

15. A method of forming an insulated concrete foundation as described in claim 14, further comprising positioning a tension anchor inside the pocket former.

16. A method of forming an insulated concrete foundation as described in claim 14, further comprising sealing the opening.

17. A method of forming an insulated concrete foundation as described in claim 16, wherein the sealing step comprises placing a sealing plug in the opening.

18. A method of forming an insulated concrete foundation as described in claim 16, wherein the sealing step comprises placing a sealing material in the opening.

19. A method of forming an insulated concrete foundation as described in claim 14, wherein the pocket former has a conical portion.

20. A method of forming an insulated concrete foundation as described in claim 19, wherein the opening is cylindrical and the pocket former has a cylindrical portion.

21. A method of forming an insulated concrete foundation as described in claim 19, wherein the pocket former has an outer surface that is threaded.

22. A method of forming an insulated concrete foundation as described in claim 14, further comprising creating an opening in the insulating form.

* * * * *